United States Patent [19]

Cosme

[11] 4,178,645

[45] Dec. 18, 1979

[54] SAFETY BED

[76] Inventor: Peter A. Cosme, R.R. 1, Box 319, Lockport, Ill. 60441

[21] Appl. No.: 865,736

[22] Filed: Dec. 29, 1977

[51] Int. Cl.[2] ..... A47C 21/08

[52] U.S. Cl. ..... 5/426; 5/100

[58] Field of Search ..... 5/331, 100, 319, 320, 5/57 R

[56] References Cited

U.S. PATENT DOCUMENTS

| | | | |
|---|---|---|---|
| 730,186 | 6/1903 | Case | 5/57 R |
| 1,066,976 | 7/1913 | Atkinson | 5/331 |
| 2,555,228 | 5/1951 | Evers | 5/331 |
| 2,611,909 | 9/1952 | Dillon et al. | 5/331 |
| 2,769,989 | 11/1956 | Woodford | 5/320 |
| 3,069,700 | 12/1962 | Berlin | 5/331 |
| 3,885,256 | 5/1975 | Du Boff | 5/331 |

*Primary Examiner*—Mervin Stein
*Assistant Examiner*—Alexander Grosz
*Attorney, Agent, or Firm*—Frank H. Marks

[57] ABSTRACT

A safety bed provided by detachably arranged on a generally standard or other bed or infant's crib a gate rotatably carried by anchor means inserted under the mattress for frictional retention, making possible instant conversion of a standard or other bed to a safety bed as well as instant reconversion thereof. The gate is secured by suitable locking means in elevated position, inhibiting passage of the occupant's body from the bed. Upon release of the lock the gate may be lowered, permitting such passage. Various alternative forms of locks are disclosed, one form permitting disengagement of the gate from the anchor means. Also, various means are disclosed for attachment to the anchor means to reduce wear on the bedding by shifting of the anchor.

8 Claims, 12 Drawing Figures

15a
40
42
35
35"
29
33
20

15a
40
27
20
18
15
10
19
S
40
27
15a
29
A
R
20
25
M 55
53
50
35'

15a
42
40
55
35'
29
36
50
36

60
29a
65
29
15a
62
15b
20

20
75'
76

20
75

15c
73
70'
72
70
20
29b

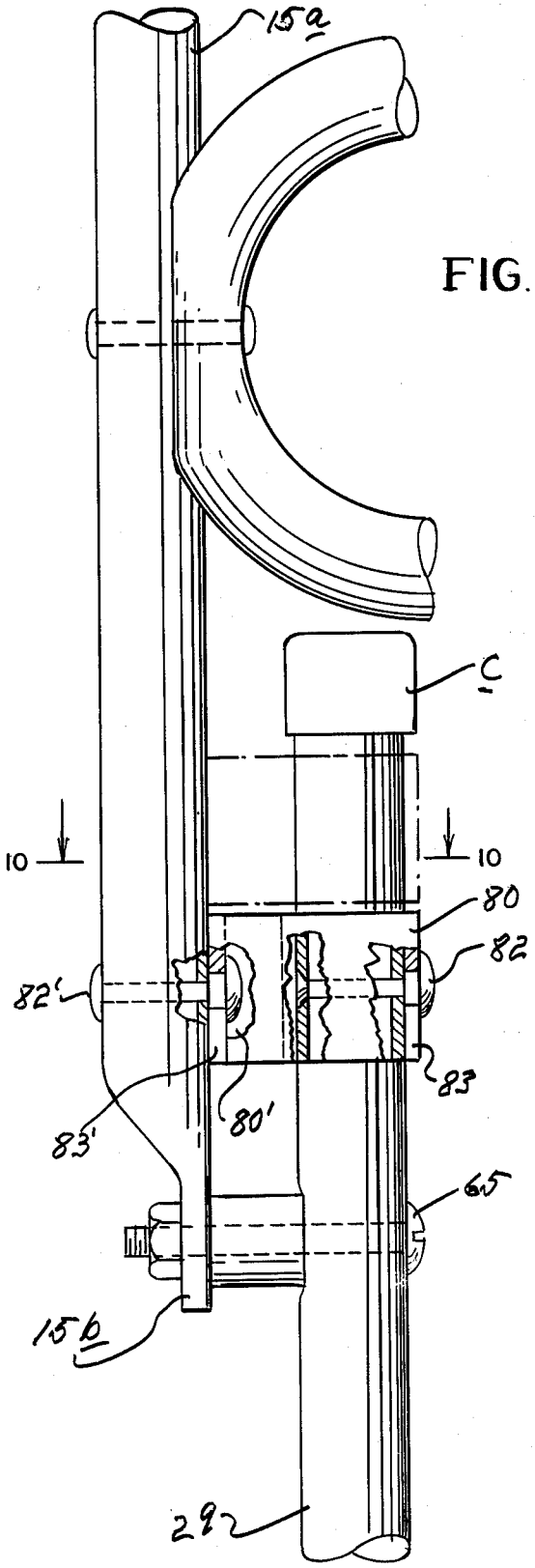
FIG. 9
FIG. 10
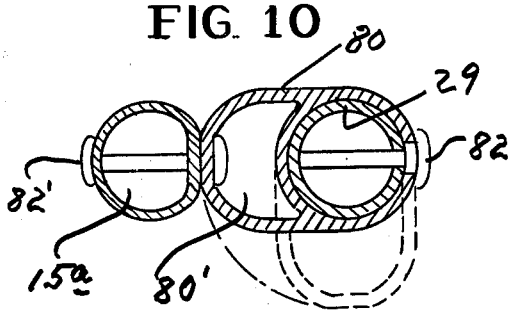
FIG. 11
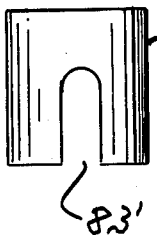
FIG. 12
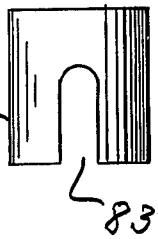

SAFETY BED

My invention relates to sleeping beds, and has to do more particularly with a safety appliance that may be applied to a standard type of bed to protect the occupant from accidentally rolling out.

While contemplated primarily for application to youth beds, my invention also is susceptible of adult use, as, for example, for hospitals or nursing homes or otherwise where the bed occupant is to be inhibited or protected from rolling out or otherwise leaving the bed for possible injury to himself.

BACKGROUND

Infants' or youth's beds and hospital beds have long been provided with movable side rails for protecting the occupant from leaving the bed, with resultant possible injury. Such devices heretofore known are a permanent fixture on the bed and may be manipulated from up to down position or vice versa either by sliding vertical movement or by rotation on a horizontal axis. Such devices are subject to the objection that they are expensive, adding materially to the initial cost of the bed. In the case of infants' cribs, furthermore, they cannot be dispensed with after the child has outgrown the need for the protection without major mechanical reconstruction.

BRIEF OUTLINE OF THE INVENTION

I have conceived of a protective guard rail that may be instantly applied to or removed from a bed without the use of tools, being collapsible or folding and mechanically unattached to the bed.

Devices embodying my invention are simple and inexpensive in construction and occupy a minimum of space when not in use and thus may be stored readily in a closet or the like after need for the item has passed, whereupon the bed may be used without the rail.

It is contemplated that devices embodying my invention are ideally suitable for mail order distribution, as they may be packed in a knockdown state and shipped in a minimum of space.

Various other objects and advantages may suggest themselves to those skilled in the art as the description proceeds.

BRIEF DESCRIPTION OF THE DRAWINGS

Referring now to the drawings illustrating certain preferred embodiments of my invention.

FIG. 9 is an elevational view of another embodiment of rail pivoting and locking means embodying my invention;

FIG. 10 is a sectional view substantially along lines 10—10 showing the locking sleeve in two positions, and FIGS. 11 and 12 are elevational views of opposite sides of said sleeve.

DETAILED DESCRIPTION

Figures 1, 2, 3, 4:
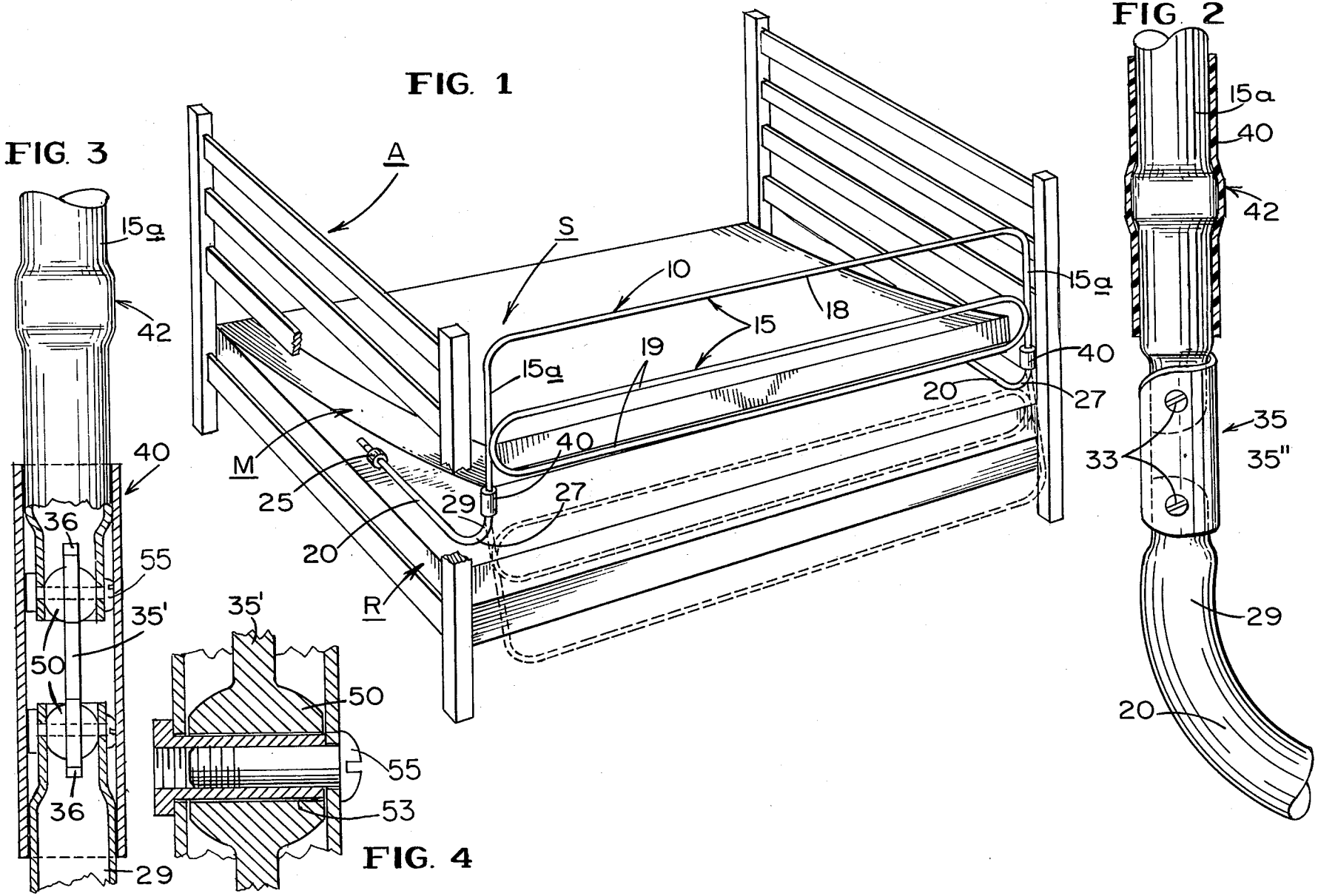
FIG. 1 is a perspective view of a bed or crib to which has been applied a guard rail embodying my invention.
FIG. 2 is a detailed perspective on an enlarged scale showing the hinge construction employed in the embodiment of FIG. 1.
FIG. 3 is a vertical section-elevation of a modified hinge construction for the rail shown in FIG. 1.
FIG. 4 is a further detailed section on a further enlarged scale of the hinge element of FIG. 3.

FIG. 1 shows a bed or crib indicated generally by character A which may have fixed rails on certain sides. In any event, it has an open side S through which the body of the occupant has normal ingress and egress and through which egress is to be inhibited. To this side S is applied a removable hinged rail embodying my invention, indicated generally by numeral 10.

Devices embodying my invention may be formed of a wide variety of materials. Preferably from the standpoint of lightness of weight, low cost and optimum suitability for the purpose I may employ lightweight tubing, say aluminum of about one inch diameter, more or less.

Rail 10 comprises a wall or gate portion 15 preferably of spaced tubing or other suitable elements. In this embodiment there is a top member 18 bent at its ends to provide integral side or leg members 15*a*, 15*a*. Secured to the leg portions are spaced parallel horizontal members 19, 19 which may conveniently be formed as a continuous loop of tubing.

Hingedly connected to each leg portion is an anchor element 20, also preferably formed of tubing, said anchors being designed to be frictionally engaged between a mattress M and its underlying support, such as box spring R or the like. I may apply to the extremities of the anchor members a sleeve 25 of suitable material, say, soft rubber, plastic or the like for enhancing the frictional engagement between mattress and anchor and protecting the mattress from undue wear resulting from shifting of the anchor members. Thus, sleeves 25 serve as mattress guards.

Opposite their free ends anchor members are each bent normally as at 27 to provide a relatively short terminal portion 29. A link 35 in the form of a U-shaped stamping, in this case, pivotally connects each anchor 20 with its adjacent leg portion 15*a*.

A wide variety of suitable hinges might be employed. In the linkage of FIG. 2 the ends of tubes 15*a* and 20 are flattened and thus received within U-shaped link 35 when the hinge is articulated, the assembly retained by screws 33 extending through apertures in the link and tubes. A longitudinally slidable sleeve 40 is frictionally retained in up position by a suitable distortion such as a bulge 42.

Thus, with the sleeve elevated, gate 15 may be swung through 180° from raised position to lowered position seen dotted in FIG. 1, and vice versa. After the gate has been raised it may be locked in said position by sliding sleeve 40 to cover the link; reversely moving the sleeve frees the hinge for articulation.

In the modified form of hinge shown in FIGS. 3 and 4 a link 35' may be cast integrally with a pair of ball-like members 50, 50 adjacent each end, said balls being each rotatably journaled on an internally threaded sleeve 53. Said sleeves are retained as by screws 55 near the ends of members 15*a* and 29, respectively.

Devices equipped with this modified linkage obviously function similarly to the arrangement previously described.

Figures 5, 6, 7, 8:
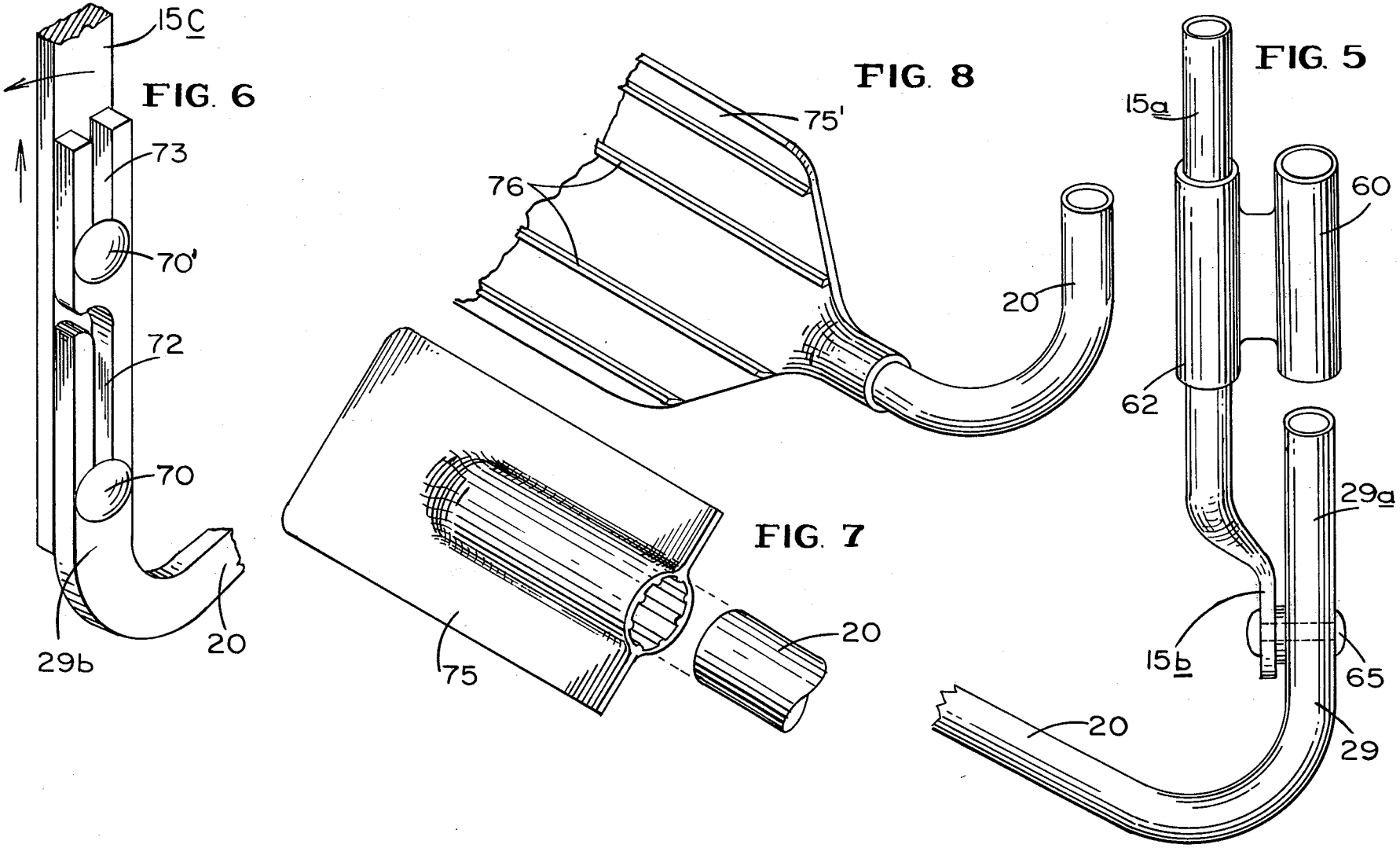
FIG. 5 is a perspective similar to FIG. 2 showing another form of hinge.
FIG. 6 is a perspective view of still another form of hinge construction.
FIG. 7 is a fragmentary perspective of an anchoring element to which a mattress guard has been attached.
FIG. 8 is a similar view showing another form of mattress guard.

In the embodiment of FIG. 5 I provide a simplified pivot, dispensing with the need for a link. In this case a terminal portion of tube 29 is extended as at 29a to provide a seat for sleeve 60 carried by a parallel integral sleeve 62 slidable on leg 15a. The end portion of the latter is offset and flattened as at 15b to provide an ear that is perforated to seat a screw 65 or the like serving as a pintle.

The operation of the embodiment of FIG. 5 will obviously be similar to the others described hereabove.

In the hinge structure of FIG. 6 I may either flatten the end portions of tubing or employ bar stock, as seen here. In any event one of the terminal portions 15c is provided with a pair of spaced rivets 70, 70' or the like engageable, respectively, in slots 72 and 73 formed in member 29b, slot 72 being in the form of a bayonet slot with a lateral entrance.

Obviously, slightly raising the gate with member 15c and slight outward rotation thereof will free pin 70' from slot 73, whereupon the gate may be swung fully down around pin 70 as a pivot to provide egress or ingress for the bed occupant. Slot 72, it will be noted, is somewhat longer than slot 73 to permit articulation of the gate or, if desired, by raising the gate somewhat higher, passage of pin 70 from its slot 72 is permitted, thus freeing the gate from its anchors.

Functioning of anchors 20 may be improved, with reduced possibility of wear on adjacent bedding, by applying to the free ends thereof a relatively flat paddle-like element 75 (FIG. 7) of molded rubber, plastic or other suitable material for increasing the area of contact between the anchor and adjacent surfaces. Such elements may be referred to as a mattress guard.

In FIG. 8 I employ a similar paddle-like member 75' provided with protuberances such as ribs 76 for further increasing friction and consequent retention of the anchor.

FIGS. 9–12, inclusive, disclose another arrangement for hingedly and detachably connecting the rail to the anchor members. Again, end portions of legs 15a are flattened at 15b for pivotal attachment to tube 29 as by screw 65.

A twin-chambered sleeve 80 is slidably secured on tube 29 as by a shouldered rivet 82 riding in a vertical slot 83 extending partway up a wall of sleeve 80, whereby downward movement of said sleeve is limited by the upper shoulder of slot 83.

Another shouldered rivet 82' extends through tube 15a and into chamber 80' of sleeve 80 where it rides in slot 83' similar to and opposite slot 83. Here, again, rivet 82' abutting the upper shoulder of slot 83' aids in limiting downward movement of sleeve 80.

It will be clear that the rail is locked in elevated position (FIG. 9) by sliding sleeve 80 down to the position where retention of rivets 82, 82' in the slots prevents rotation of the rail. By lifting sleeve 80 to disengage said rivets from the slots, the rail is freed to rotate to its lower position.

Various other changes coming within the scope of my invention may occur to those skilled in the art without departing from the spirit of my invention. Hence, I do not wish to be limited to the specific forms shown or uses mentioned except to the extent indicated in the appended claims.

I claim:

1. A knockdown, readily detachable attachment for the side of a bed and mattress with an underlying support for the latter, comprising (a) a restraining gate of planar form with vertical end legs, adapted to assume selectively an elevated operative position above the side of the bed and mattress, to block egress therefrom, and an alternative lowered inoperative position below the bed and mattress, to permit egress from the bed, both positions being in the same substantially vertical plane, (b) anchor means for said gate adapted to be disposed between the mattress and said support, said anchor means comprising a pair of bar members constituting extensions of the respective end legs, each said extension having a free end portion with frictional resistance means against accidental displacement, the other end of each bar member being bent substantially normally to provide a connecting portion between the bar member and its adjacent leg, (c) linkage means pivoted respectively to each bar member and its adjacent leg, permitting articulation of the gate from said elevated to lowered position, and (d) relatively slidable means coaxial with each bar member and its adjacent leg for locking the gate in elevated position and, alternatively, freeing the gate for rotation downwardly to inoperative position.

2. An apparatus as set forth in claim 1, wherein said vertical end legs of said restraining gate and the bar members of said anchor means are of tubular formation.

3. An apparatus as set forth in claim 1, wherein said vertical end legs of said restraining gate and the bar members of said anchor means are of tubular formation with the upwardly curved end of each bar member laterally offset from the end of the respective leg member, said rigidifying means comprising shiftable sleeve means on said ends for selectively rigidifying and releasing the joint therebetween.

4. A combination as in claim 1, wherein the slidable means is a tubular member positioned, when in operative locking position, in juxtaposition to said linkage and coaxially engaging the extremities of the bar member and leg.

5. A knockdown safety-gate attachment for the side of a bed and mattress supporting means, readily detachable therefrom, comprising (a) a restraining gate of planar form with vertical end legs, adapted to assume selectively an operative position in a vertical plane on the side of the bed and above the mattress to block egress therefrom, and an alternative inoperative position in a substantially vertical plane on the side of the bed and below the mattress to permit ready egress from the bed, (b) anchor means for said gate adapted to be disposed below the mattress and comprising a bar member coincident with each of said end legs and having the main portion thereof locked against movement between the bottom of the mattress and its underlying support and a short end portion thereof projecting beyond the side of the mattress and curving upwardly in a vertical direction and laterally offset from the end of the respective end leg of the gate, (c) a pivotal joint between said end portion of each bar member and the end of each leg, and (d) means for selectively rigidifying said joint to fix the gate in an upstanding vertical plane or releasing said joint for complete detachment of the gate or pivotal movement thereof to permit the swinging movement of said gate to its inoperative position below the mattress, comprising interengageable and disengageable slot-and-pin means in each anchoring bar member and respective leg.

6. A knockdown safety-gate attachment for the side of a bed and mattress supporting means, readily detachable therefrom, comprising (a) a restraining gate of planar form with vertical end legs of tubular formation adapted to assume selectively an operative position in a vertical plane on the side of the bed and above the mattress to block egress therefrom, and an alternative inoperative position in a substantially vertical plane on the side of the bed and below the mattress to permit ready egress from the bed, (b) anchor means for said gate adapted to be disposed below the mattress and comprising a bar member of tubular formation coincident with each of said end legs and having the main portion thereof locked against movement between the bottom of the mattress and its underlying support and a short end portion thereof projecting beyond the side of the mattress and curving upwardly in a vertical direction in proximity to and laterally offset from the end of the respective end leg of the gate, (c) a pivotal joint between said end portion of each bar member and the end of each leg, and (d) shiftable sleeve means for selectively rigidifying said joint to fix the gate in an upstanding vertical plane or releasing said joint for pivotal movement to permit the swinging movement of said gate to its inoperative position below the mattress comprising an integrated pair of cylindrical sleeves each movable on the tubular ends of said leg and bar member above the pivotal joint therebetween.

7. A knockdown safety-gate attachment for the side of a bed and mattress supporting means, readily detachable therefrom, comprising (a) a restraining gate of planar form with vertical end legs of tubular formation adapted to assume selectively an operative position in a vertical plane on the side of the bed and above the mattress to block egress therefrom, and an alternative inoperative position in a substantially vertical plane on the side of the bed and below the mattress to permit ready egress from the bed, (b) anchor means for said gate adapted to be disposed below the mattress and comprising a bar member of tubular formation coincident with each of said end legs and having the main portion thereof locked against movement between the bottom of the mattress and its underlying support and a short end portion thereof projecting beyond the side of the mattress and curving upwardly in a vertical direction in proximity to and laterally offset from the end of the respective end leg of the gate, (c) a pivotal joint between said end portion of each bar member and the end of each leg, (d) rivets extending diametrally and coaxially across each end leg and bar member adjacent the pivotal joint therebetween, each with a headed end projecting therebeyond, and (e) shiftable sleeve means for selectively rigidifying said joint to fix the gate in an upstanding vertical plane or releasing said joint for pivotal movement to permit the swinging movement of said gate to its inoperative position below the mattress comprising a dual sleeve member having spaced vertical slots in the lateral wall thereof extending from the bottom edge, and in alignment with said headed ends, for selective engagement therewith or release therefrom.

8. An apparatus as set forth in claim 6 including a substantially flattened paddle-like element with protuberances on its outer surfaces, detachably connected to the inner end of each bar member for increasing the frictional contact between the underlying support and superposed mattress.

* * * * *